US008608432B2

(12) United States Patent
Morgan

(10) Patent No.: US 8,608,432 B2
(45) Date of Patent: Dec. 17, 2013

(54) COOLING SYSTEM

(76) Inventor: Daniel McKie Morgan, Edgefield, SC (US)

( * ) Notice: Subject to any disclaimer, the term of this patent is extended or adjusted under 35 U.S.C. 154(b) by 557 days.

(21) Appl. No.: 13/026,584

(22) Filed: Feb. 14, 2011

(65) Prior Publication Data

US 2012/0207587 A1 Aug. 16, 2012

(51) Int. Cl.
*F04D 29/60* (2006.01)

(52) U.S. Cl.
USPC ..... 415/126; 415/121.2; 415/129; 415/213.1; 415/220; 415/223; 416/100; 416/140; 416/148; 416/246; 416/247 R

(58) Field of Classification Search
USPC ..... 415/121.2, 126, 127, 129, 213.1, 220, 415/223; 416/100, 131, 140, 148, 149, 159, 416/246, 247 R
See application file for complete search history.

(56) References Cited

U.S. PATENT DOCUMENTS

| | | | | |
|---|---|---|---|---|
| 1,549,440 | A * | 8/1925 | Breidert et al. | 454/210 |
| 1,698,328 | A | 1/1929 | Duffie | |
| 2,620,721 | A * | 12/1952 | Krauss | 415/121.2 |
| 2,691,336 | A * | 10/1954 | Nash | 454/210 |
| 2,733,002 | A * | 1/1956 | Huck | 417/338 |
| 2,805,820 | A * | 9/1957 | Evarts | 417/238 |
| 2,830,779 | A * | 4/1958 | Wentling | 416/244 R |
| 2,857,095 | A * | 10/1958 | Suarez Grau | 416/246 |
| 4,222,318 | A | 9/1980 | Patton et al. | |
| 4,341,151 | A * | 7/1982 | Sakamoto | 416/247 R |
| 4,838,151 | A * | 6/1989 | Shin-Chin | 454/200 |
| 4,872,399 | A * | 10/1989 | Chaney | 454/210 |
| 5,743,709 | A * | 4/1998 | Jane et al. | 415/125 |
| 6,272,874 | B1 | 8/2001 | Keeney | |
| 6,336,793 | B1 * | 1/2002 | Litvin | 416/246 |
| 6,945,868 | B2 | 9/2005 | Gautney | |
| 2003/0064677 | A1 | 4/2003 | Terrell et al. | |
| 2003/0140550 | A1 | 7/2003 | Seniff | |

* cited by examiner

*Primary Examiner* — Igor Kershteyn
(74) *Attorney, Agent, or Firm* — Nelson Mullins Riley & Scarborough LLP

(57) ABSTRACT

A fan configured for integration with a structure having at least two support members is disclosed. The fan comprises a fan guard, a fan blade surrounded by the fan guard, and first and second mounting brackets. Each of the first and second mounting brackets is configured for connection to a respective one of the support members. The fan also comprises first and second connectors oppositely disposed on the fan guard and configured for connection to a respective one of first and second mounting brackets. The first and second connectors are adjustable with respect to the first and second mounting brackets, and the fan is configured to rotate between at least two struts. Rotation of the fan between the at least two struts is limited such that an opening defined by one of the struts and said fan guard does not exceed a predetermined size.

20 Claims, 13 Drawing Sheets

COOLING SYSTEM

BACKGROUND OF THE INVENTION

The present invention relates generally to cooling systems comprising a fan. More particularly, the invention relates to a cooling system comprising a fan that is configured for adjustable integration with a structure.

Various types of fans are known in the art. For example, outdoor installations may include ceiling fans mounted above a deck, patio, or porch. However, ceiling fans require an overhead structure for mounting and typically force air downwards in only a single direction. In an outdoor setting, ceiling fans also have a tendency to recirculate warm air that has risen, rather than cooler air closer to the ground.

Other types of fans are known for outdoor use, such as box fans and pedestal fans. Although such fans may be configured to oscillate and thus direct air in multiple directions, they can be cumbersome. In particular, they take up a relatively large amount of space on a deck that may be used for recreation or leisure. Also, these fans are not typically designed for permanent outdoor installation, and thus their use on a deck may be unsightly and hazardous in some circumstances.

Fences, railings, and the like are typically used to delimit and/or enclose an outdoor area. For example, regulations often require decks and pools to be enclosed by a fence. Fences are also used with residential and commercial patios, porches, and piers or docks. Although fence design varies, one familiar fence arrangement includes top and bottom rails extending horizontally between a plurality of posts, which support the fence. A series of struts are spaced between the posts and are arranged vertically between the top and bottom rails. Often, the jurisdiction in which the fence is located has building regulations which govern the maximum spacing between the struts.

SUMMARY OF THE INVENTION

The present invention recognizes and addresses disadvantages of prior art constructions and methods. In one aspect, the present invention provides a fan configured for integration with a fence, wherein the fence has at least two support members. The fan comprises a fan guard, a fan blade surrounded by the fan guard, and first and second mounting brackets. Each of the first and second mounting brackets is configured for connection to a respective one of the support members. The fan also comprises a first connector comprising a proximal end and a distal end, wherein the proximal end of the first connector is attached to the fan guard and the distal end of the first connector is configured for connection to the first mounting bracket. Similarly, the fan further comprises a second connector comprising a proximal end and a distal end, wherein the proximal end of the second connector is attached to the fan guard and the distal end of the second connector is configured for connection to the second mounting bracket. The second connector is disposed opposite the first connector on the fan guard. Notably, the first and second connectors are adjustable with respect to the first and second mounting brackets, and the fan is configured to rotate between at least two struts of the fence. Finally, at least one of the first and second connectors cooperate with a respective one of the first and second mounting brackets to limit rotation of the fan between the at least two struts, wherein an opening defined by one of the struts and the fan guard does not exceed a predetermined size.

According to a further aspect, the present invention provides a cooling system for integration with a fence, wherein the fence comprises at least two support members. The cooling system comprises a fan comprising a fan guard comprising a front grille and a rear grille. The fan guard defines an interior volume of the fan. The fan further comprises a motor coupled to the rear grille and a fan blade coupled to the motor, wherein the fan guard surrounds the fan blade. The fan also comprises first and second connectors attached to the fan guard. Additionally, the cooling system comprises first and second mounting brackets slidably coupled to the first and second connectors, respectively. The first and second mounting brackets are each configured for connection to a respective one of the at least two support members. The cooling system further comprises means for limiting rotation of the fan between at least two struts of the fence. Finally, the cooling system also comprises a plurality of spacers configured for connection to the at least two struts. The spacers reduce the size of openings between the at least two struts and the fan guard.

In a further aspect, the present invention provides an outdoor structure comprising a fence comprising a top rail, a bottom rail, and a pair of substantially parallel struts disposed between the top and bottom rails. The outdoor structure also comprises at least one fan coupled with the fence, the at least one fan comprising a fan guard comprising at least one grille, a motor coupled to the at least one grille, and a fan blade coupled to the motor via a rotatable shaft, wherein the fan guard surrounds the fan blade. The at least one fan also comprises first and second mounting brackets each mounted to a respective one of the top rail and the bottom rail. Further, the fan comprises a first connector comprising a proximal end and a distal end, wherein the proximal end of the first connector is attached to the fan guard and the distal end of the first connector is configured for connection to the first mounting bracket. Finally, the fan comprises a second connector comprising a proximal end and a distal end, wherein the proximal end of the second connector is attached to the fan guard and the distal end of the second connector is configured for connection to the second mounting bracket. The second connector is disposed opposite the first connector on the fan guard. Notably, the first and second connectors are adjustable with respect to the first and second mounting brackets, and the at least one fan is rotatable about an axis defined by the first and second connectors.

Those skilled in the art will appreciate the scope of the present invention and realize additional aspects thereof after reading the following detailed description of the preferred embodiments in association with the accompanying drawing figures.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1A:
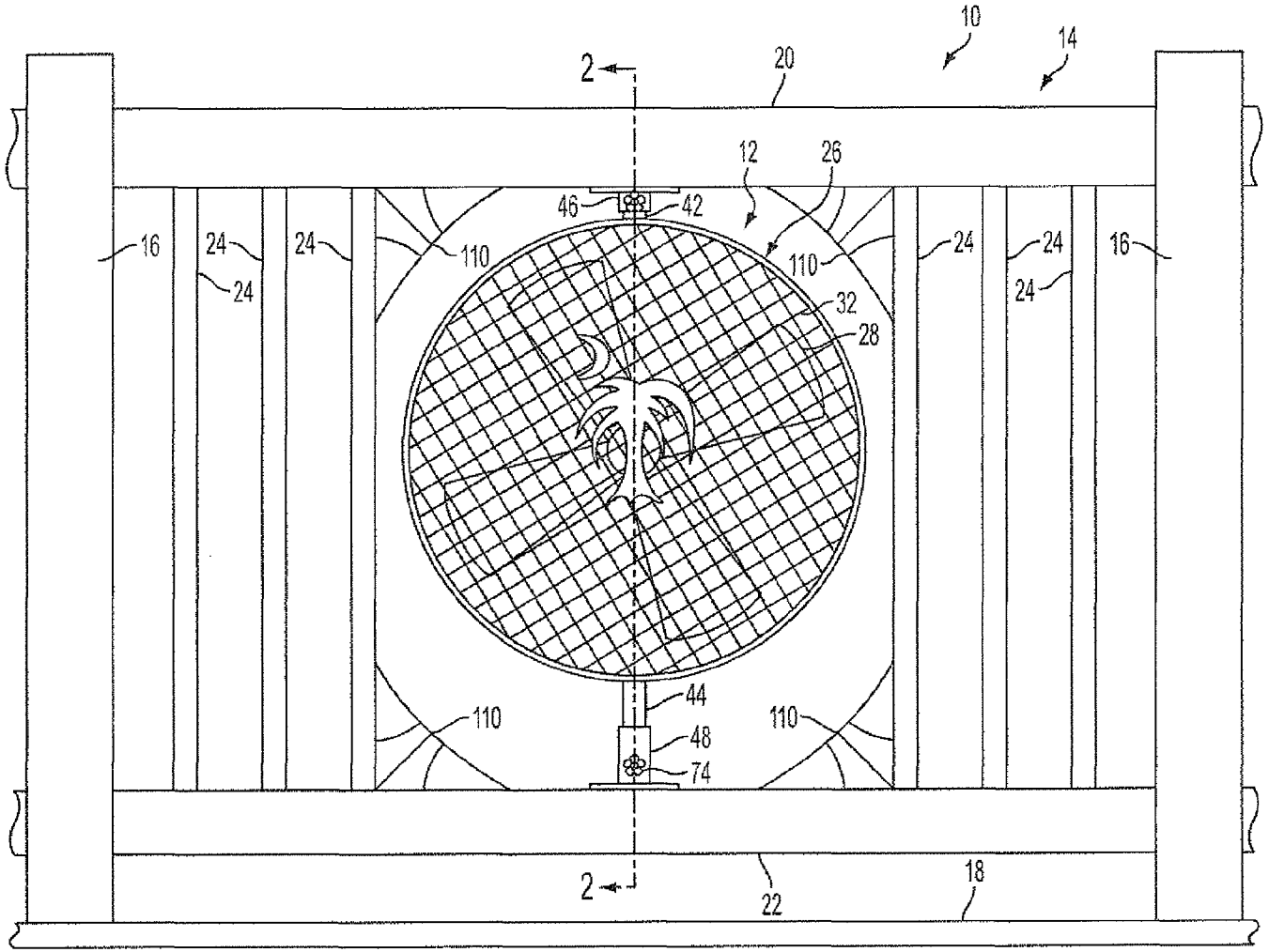
FIG. 1A is a front view of a cooling system according to an embodiment of the present invention.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Embodiments of the present invention provide a cooling system comprising a fan coupled with a structure, such as a fence. Because the fan may be integrated with the structure, the fan may provide cooling without taking up additional space on, for example, a deck, patio, or the like and without the need for an overhead structure. For example, this may be desirable in a restaurant patio setting, where a pedestal or box fan may take up valuable space for seating patrons. Although the cooling system of the present invention is described below as comprising a single fan coupled with a fence, it will be appreciated that a plurality of fans may be coupled in different places along a particular structure. The fans may be in electrical communication to facilitate control thereof. This may be desirable for providing a cooling airflow over a large area.

The fan is preferably adjustable such that it may be "retrofit" with structures of different types and sizes, and the fan is preferably configured for rotation so that the fan may provide cooling in multiple directions. In embodiments where the structure is a fence, rotation of the fan may be limited so that an opening between the fan and struts of the fence does not exceed a predetermined size, such as those requirements specified in building codes or regulations of the jurisdiction in which the fence is located. Further, the fan may also comprise a magnetic coupling which allows different types of decorative indicia to be removably attached to the fan.

The term "fence" is used broadly herein to refer to any type of vertical barrier or guard used to partially or completely delimit, enclose, or restrict access to an area. As described below, a fence may comprise a plurality of posts and at least two support members. Examples of support members include top and/or bottom rails of the fence and struts, such as pickets or stanchions, disposed between the rails. It is contemplated that the present invention may be used with fences formed of any suitable material, including wood, metals such as wrought iron or aluminum, and ceramic materials such as bricks.

Some embodiments of the present invention are particularly suitable for use in association with a fence on an outdoor deck, and the below discussion will describe preferred embodiments in that context. However, those of skill in the art will understand that the present invention is not so limited. In fact, it is contemplated that the present invention may be used with any other appropriate fence or enclosure.

Figure 1B:
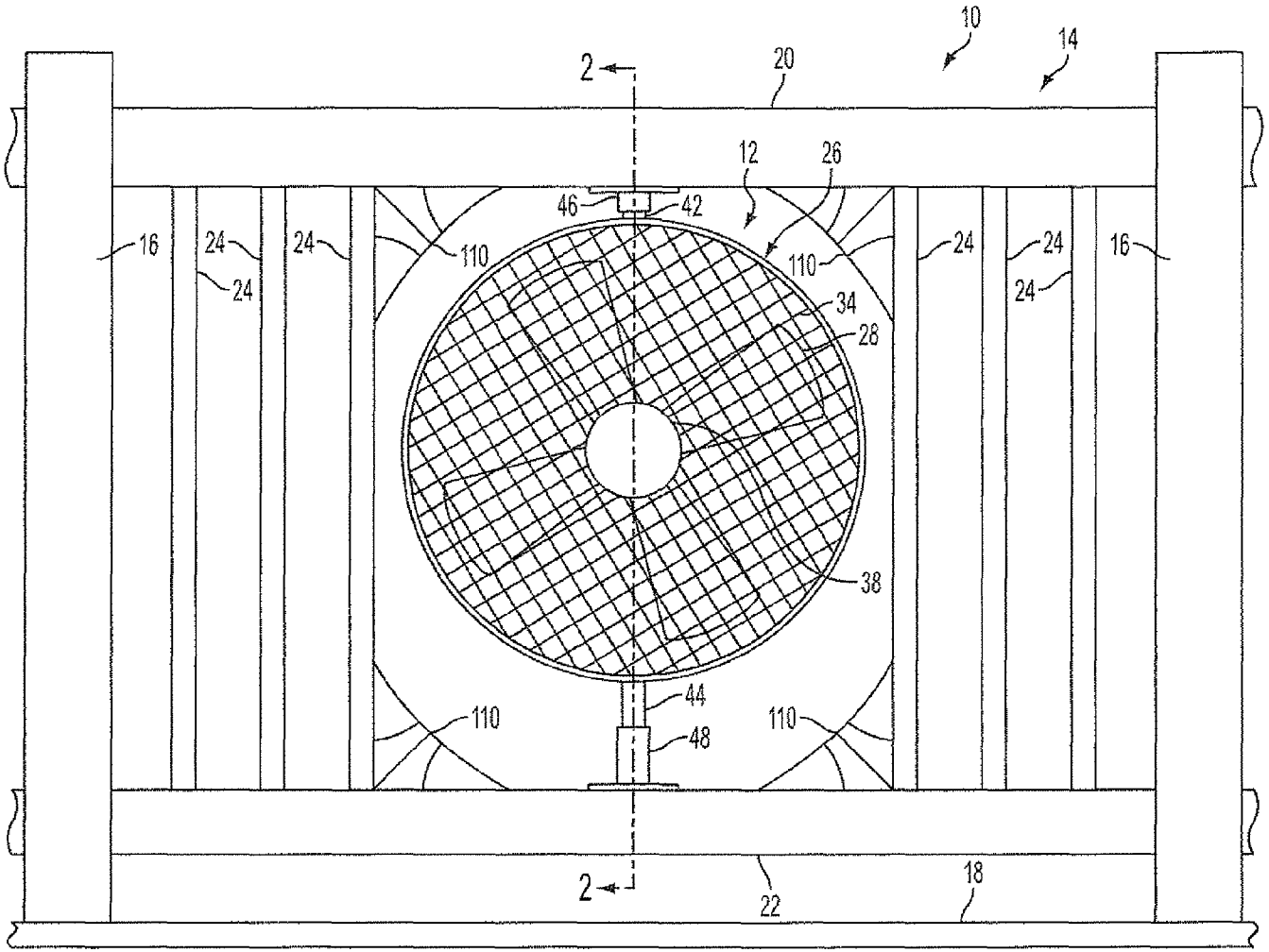
FIG. 1B is a rear view of the cooling system of FIG. 1A.

Referring now to FIGS. 1A and 1B, respective front and rear views of a cooling system 10 comprising a fan 12 coupled with a fence 14 are illustrated according to an embodiment of the present invention. In this embodiment, fence 14 may extend along an edge of a deck (not shown). Fence 14 comprises a plurality of posts 16 coupled to a deck floor 18. As will be appreciated, posts 16 provide the basic support structure of fence 14. Top and bottom rails 20, 22 extend horizontally between each post 16, and struts 24 are disposed vertically between rails 20, 22. It will be appreciated that in some fences, bottom rail 22 may not be provided, such that struts 24 are disposed between top rail 20 and deck floor 18.

Here, three struts 24, which may be pickets, stanchions, or the like, are spaced equally on either side of fan 12 between posts 16. As described below, the cooling system of the present invention may preferably be configured for installation in preexisting fences with varying dimensions. Thus, to install fan 12 in a preexisting fence (rather than building a fence to incorporate fan 12), one or more struts 24 may need to be removed.

Figure 2:
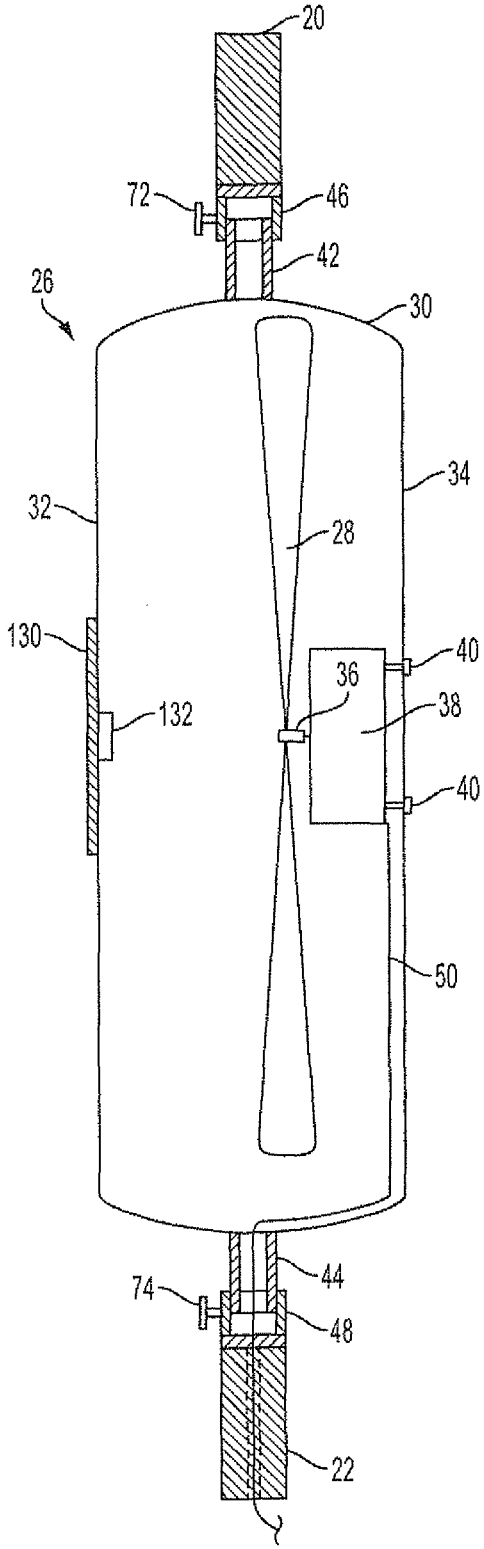
FIG. 2 is a cross-sectional view along line 2-2 of FIG. 1A.
Figure 9:
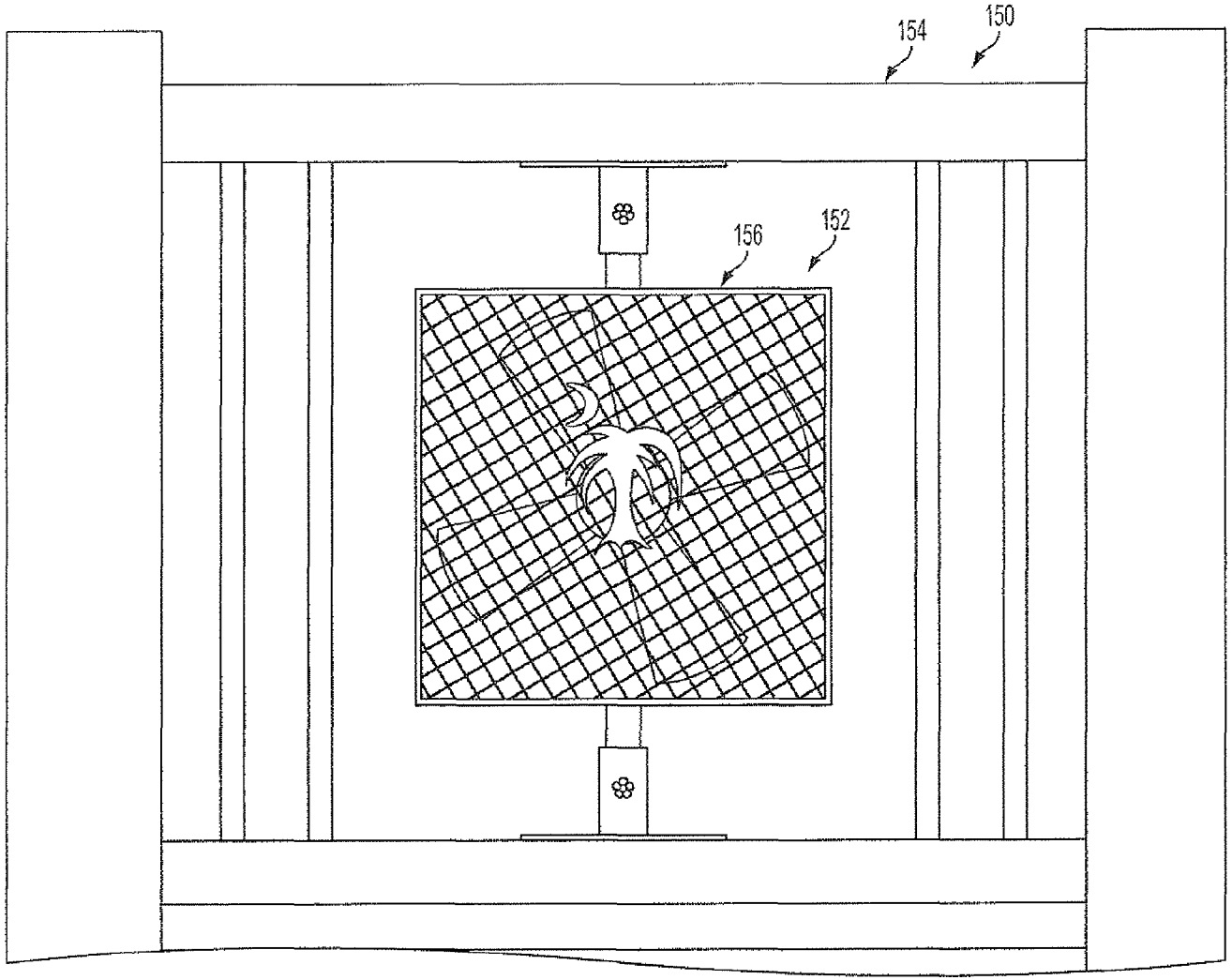
FIG. 9 is a front view of a cooling system according to a further embodiment of the present invention.

Referring also to FIG. 2, which is a cross-sectional view along line 2-2 of FIG. 1A, fan 12 may comprise a fan guard 26 surrounding a fan blade 28. Fan guard 26 may comprise a shroud 30, a front grille 32, and a rear grille 34, which collectively define an interior volume of fan 12. Shroud 30 and grilles 32, 34 (and thus, fan guard 26) may take any suitable shape. In the illustrated embodiment, for example, shroud 30 may be a shallow, 3/16" steel cylinder connected to circular grilles 32, 34. Alternatively, FIG. 9 shows a front view of a cooling system 150 comprising a fan 152 coupled with a fence 154 according to an embodiment of the present invention having a square fan guard 156. In any case, fan blade 28 may be carried by shaft 36 of a fan motor 38, which may be suitably affixed to rear grille 34. Here, for example, motor 38 may be affixed to a metal plate (not shown) on rear grille 34 with bolts 40.

Fan 12 may be configured for permanent installation between two support members of fence 14. In the illustrated example, fan 12 is mounted between top rail 20 and bottom rail 22. However, other embodiments are contemplated wherein fan 12 may be mounted between struts 24. Fan 12 may be installed between support members of a fence using any suitable mounting means. For example, in the embodiment shown, fan 12 comprises first and second connectors 42, 44 disposed oppositely on fan guard 26. The proximal ends of first and second connectors 42, 44 are coupled to the periphery of fan guard 26; their distal ends are preferably configured for connection to first and second mounting brackets 46, 48, respectively. These connections are described in more detail below.

Fan 12 may be a weather-proof fan configured for outdoor use. Those of skill in the art are familiar with suitable stain- and corrosion-resistant materials for fan 12, such as stainless steel or aluminum alloy. Likewise, fan motor 38 may be a "totally-enclosed" motor configured for all-weather use. Those of skill in the art can select the size and operating characteristics of motor 38 depending on the needs of a particular installation and other factors (such as the desired amount of cubic feet per minute (CFM) of air). In one embodiment, fan motor 38 may be a variable-speed, ⅓ HP motor which operates on 110 VAC power, similar to a weather-proof air conditioner condenser fan motor.

According to a further embodiment, fan 12 may also comprise a mister (not shown) configured to be coupled to a liquid source (not shown). More specifically, the mister may be a ring-shaped tube received around fan guard 26 or shroud 30. The tube may be coupled to a water source when it is desired to provide cooling using not only air flow, but also a fine vapor mist. Unlike spray devices which are mounted to a fixed point, the mister may rotate with fan 12 to provide cool mist in more than one direction. This arrangement may be desirable in certain outdoor settings, such as around a pool.

According to a further embodiment, motor 38 may be remotely-controllable such that a user may adjust the speed of motor 38 and fan 12 from a distance. Thus, motor 38 or fan 12 may comprise a radio-frequency or infrared transceiver for remote or wireless communications.

Referring again to FIG. 2, motor 38 may be in electrical communication with a power source (not shown) via suitable wiring 50. To enhance the appearance of fan 12, wiring 50 may extend through the interior volume of fan 12, connector 44, and mounting bracket 48. Wiring 50 may also be concealed by extending through or along a rear surface of bottom rail 22. A ground fault circuit interrupter (GFCI) or other residual current device may be provided to enhance safety. As noted above, where cooling system 10 comprises a plurality of fans 12 along fence 14, fans 12 may also be in electrical communication with each other.

Figure 3A:
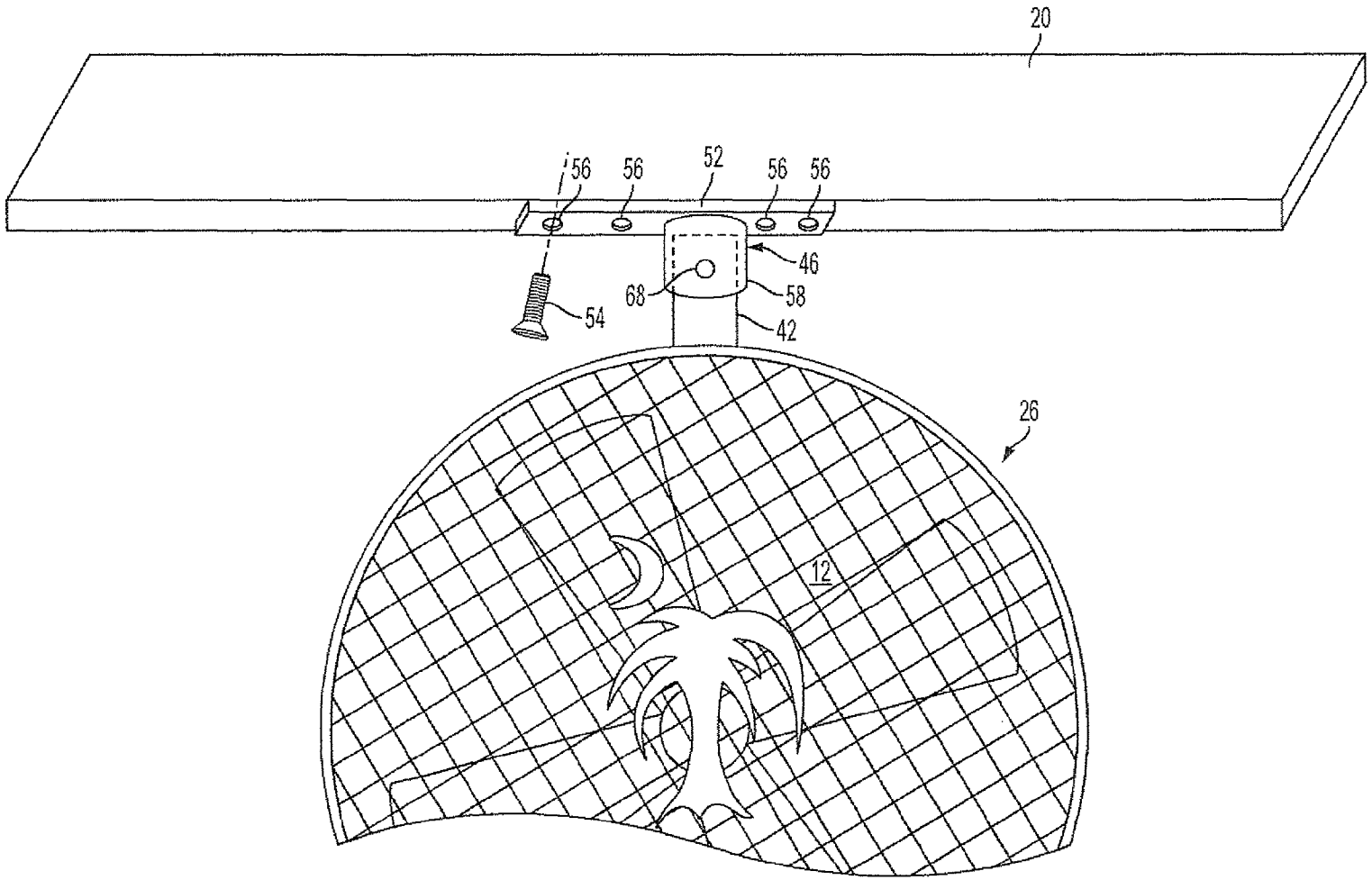
FIG. 3A is a detail view of a connector shown in FIGS. 1A-B.
Figure 3B:
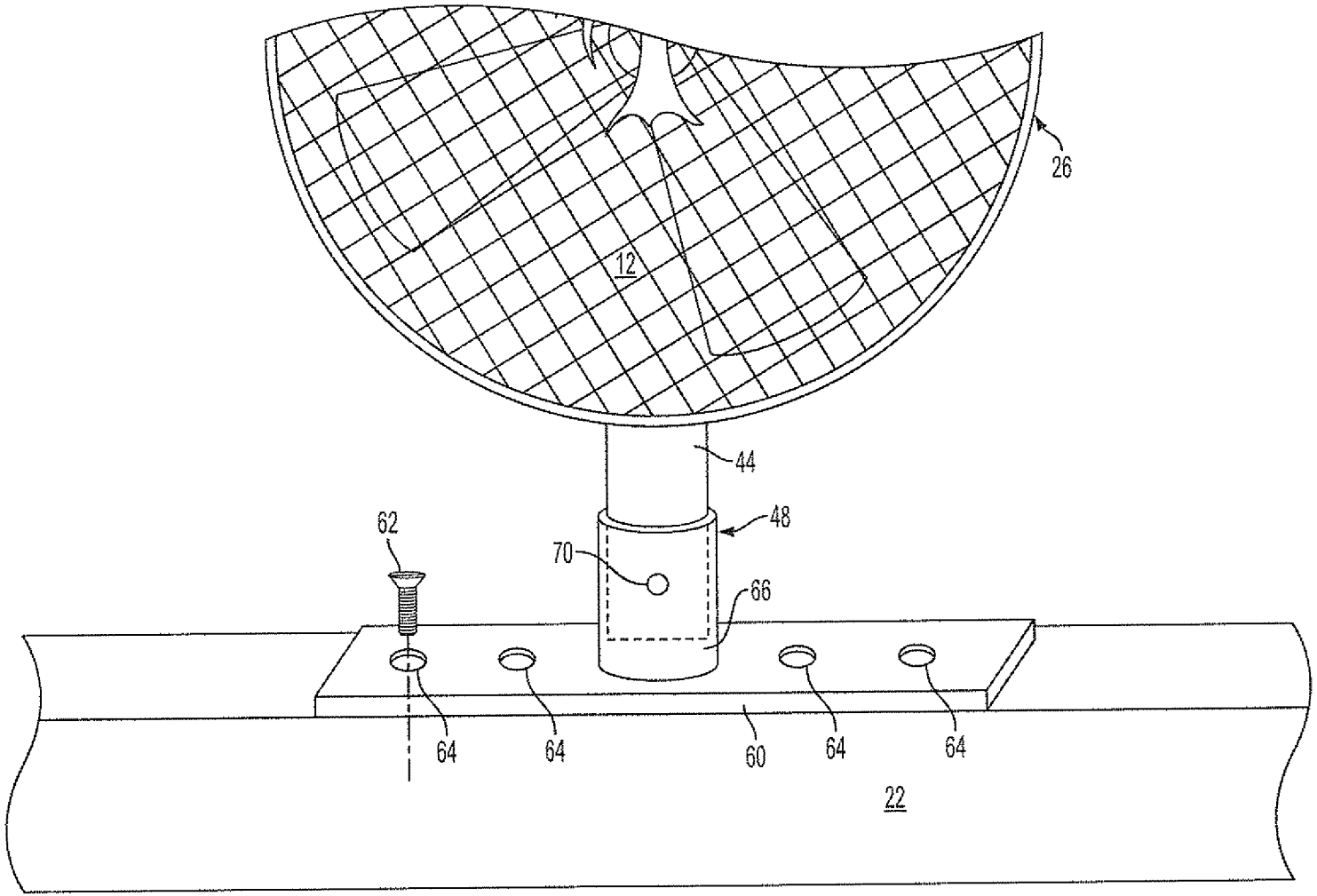
FIG. 3B is a detail view of another connector shown in FIGS. 1A-B.

FIGS. 3A-3B are detail views of the connections between fan 12 and top and bottom rails 20, 22, respectively, according to an embodiment of the present invention. As noted above and as shown in the examples described with reference to FIGS. 10 and 11, below, other suitable mounting means may be provided to install fan 12 between two support members of fence 14. It is preferred, however, that the connection between fan 12 and the support members of fence 14 be adjustable so that fan 12 can be coupled with fences of differing dimensions. Thus, in the illustrated embodiment, first and second connectors 42, 44 are adjustable with respect to first and second mounting brackets 46, 48. For example, when it is desirable to raise the height of fan 12, first connector 42 may be inserted farther into first mounting bracket 46 while second connector 44 is pulled a proportionate amount out of second mounting bracket 48.

Further, when it is desirable to point fan 12 at a different angle relative to fence 14, first and second connectors 42, 44 rotate with respect to first and second mounting brackets 46, 48. Rotation may be manual or automatic and may be actuated by remote control as described above. In particular, in some embodiments fan 12 may comprise an oscillation device to facilitate automatic rotation. Those of skill in the art are familiar with suitable oscillation devices for rotation of fan 12.

More particularly, connectors 42, 44 may comprise an elongate tube or sleeve projecting from fan guard 26. As noted above, connectors 42, 44 may preferably be disposed opposite one another on shroud 30 and may be affixed thereto by any suitable means, such as by welding. First mounting bracket 46 may preferably comprise a metal plate 52 configured for connection to a support member of fence 14. Here, metal plate 52 may be mounted to top rail 20 via suitable fasteners 54, which may be received in apertures 56 defined in plate 52. First mounting bracket 46 may further comprise an elongate tube or sleeve 58 centered on a surface of plate 52 which faces fan 12. In some embodiments, second mounting bracket 48 may be constructed identically to first mounting bracket 46. Thus, second mounting bracket 48 may comprise a plate 60 mounted to bottom rail 22 via suitable fasteners 62 received in apertures 64 defined in plate 60. Likewise, second mounting bracket 48 may comprise an elongate tube or sleeve 66 centered on a surface of plate 60 which faces fan 12.

In one embodiment, the inner diameter of sleeves 58, 66 is equal to or slightly larger than the outer diameter of connectors 42, 44 such that when connectors 42, 44 are received in sleeves 58, 66, connectors 42, 44 (and thus fan 12) may rotate freely with respect to mounting brackets 46, 48. It will be appreciated, however, that other connecting arrangements are contemplated. For example, in alternative embodiments sleeves 58, 66 may have an outer diameter slightly smaller than the inner diameter of connectors 42, 44, such that sleeves 58, 66 may be received in connectors 42, 44.

As explained above, it is preferred that the relative distance between mounting bracket 46 and mounting bracket 48 (as measured along an axis defined by sleeves 58, 66) may be adjusted to accommodate a range of distances between support members while still supporting fan 12. Thereby, a fence suitable for coupling with fan 12 need not have support members spaced a single, predetermined distance apart. In this regard, one of skill in the art may select an appropriate length of mounting brackets 46, 48 and sleeves 58, 66 to permit adjustment over a desired range of distances between support members.

Further, mounting brackets 46, 48 may preferably comprise an adjustment mechanism configured to fix the height and direction of fan 12 as desired. For example, the adjustment mechanism may comprise respective threaded apertures 68, 70 in sleeves 58, 66 adapted to receive a threaded adjustment knob 72, 74 (FIGS. 1A-1B). In some embodiments (such as the embodiment discussed below with respect to FIG. 4A), only one of mounting brackets 46, 48 may define an adjustment mechanism. In any case, after mating connectors 42, 44 with sleeves 58, 66, a user may adjust the position of fan 12 along the longitudinal axis between sleeves 58, 66. At the same time, because fan 12 may rotate with respect to mounting brackets 46, 48, a user may position fan 12 to direct its airflow at a particular angle with respect to fence 14. Once fan 12 is in a desired position, a user may tighten adjustment knobs 72, 74 to secure fan 12 in place.

As described above, many jurisdictions may have building regulations or codes governing fences which limit the size of an opening between support members of a fence. For example, building regulations may specify that support members not allow passage of an object 6" or more in diameter. Other building regulations limit the size of an opening between support members of a fence to no more than about 4". Thus, where fan 12 is configured for rotation between support members, it may be desirable to limit rotation to comply with building regulations in a particular jurisdiction.

Figure 4E:
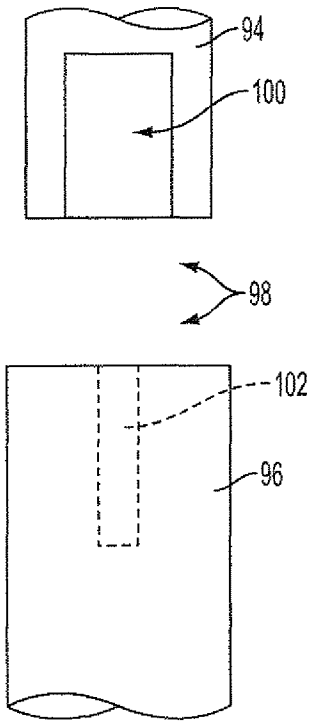
FIG. 4E is a partial front view of the connector and mounting bracket of FIG. 4D.
Figure 4D:
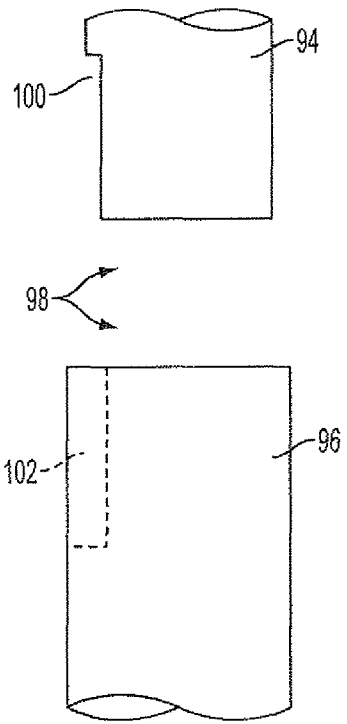
FIG. 4D is a partial side view of a connector and mounting bracket according to a further embodiment of the present invention.
Figure 4B:
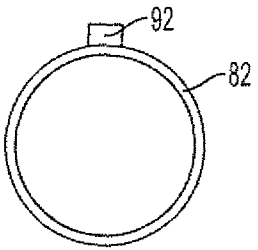
FIG. 4B is a partial top view of the mounting bracket of FIG. 4A.
Figure 4C:
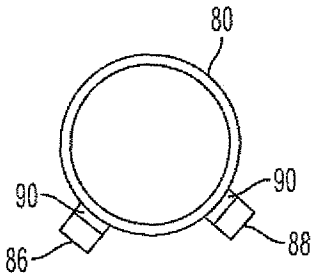
FIG. 4C is a bottom view of the connector of FIG. 4A.
Figure 4A:
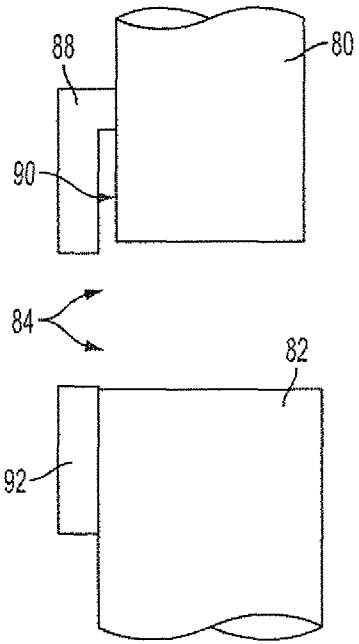
FIG. 4A is a partial side view of a connector and mounting bracket according to a further embodiment of the present invention.

In this regard, FIGS. 4A-E illustrate two embodiments of stop features to limit rotation of fan 12 between support members. According to one embodiment, FIG. 4A is a partial side view of a connector 80 and a mounting bracket 82 configured for connection to fan 12 and bottom rail 22, respectively. Connector 80, which is preferably similar to connector 44, and mounting bracket 82, which is preferably similar to mounting bracket 48, comprise a stop feature 84 to limit rotation of fan 12 between support members. FIG. 4B is a partial top view of mounting bracket 82, and FIG. 4C is a bottom view of connector 80.

More particularly, stop feature 84 may comprise at least one projection coupled to connector 80 and at least one projection coupled to mounting bracket 82 which are designed to interfere when a user attempts to rotate fan 12 beyond a predefined angle in either direction. For example, in the illustrated embodiment, connector 80 may comprise two L-shaped projections 86, 88. Projections 86, 88 are preferably affixed to the periphery of connector 80 and spaced to define the angle through which it is desired that fan 12 be allowed to rotate. Projections 86, 88 may define a gap 90 which allows them to rotate along the periphery of mounting bracket 82 when connector 80 is inserted therein. Further, projections 86, 88 may be formed of key stock and may be affixed to connector 80 by any suitable technique, such as by welding. Similarly, mounting bracket 82 comprises a projection 92 affixed to its periphery and configured to interfere with projections 86, 88 when one attempts to rotate fan 12 beyond the predetermined angle. Projection 92 may likewise be formed of key stock and be affixed to mounting bracket 82 by any suitable technique.

According to a further embodiment, FIG. 4D is a partial side view of a connector 94 and a mounting bracket 96 configured for connection to fan 12 and bottom rail 22, respectively. Here, connector 94 and mounting bracket 96 comprise a stop feature 98 to limit rotation of fan 12 between support members. FIG. 4E is a partial front view of connector 94 and mounting bracket 96. More particularly, stop feature 98 may comprise an aperture 100 defined in connector 94. The width of aperture 100 preferably defines the angle through which it is desired that fan 12 be allowed to rotate. Stop feature 98 further comprises at least one projection 102 affixed to the inner periphery of mounting bracket 96. Projection 102, which may preferably be similar to projection 92, may be received in aperture 100 when connector 94 is inserted in mounting bracket 96. Thus, when one attempts to rotate fan 12 beyond the predetermined angle, projection 102 will interfere with connector 94 via aperture 100.

It will be appreciated that other types of stop features may be used to limit rotation of fan 12 within the scope of the present invention, including detent mechanisms, ratchets, or the like.

Although the various stop features described above may be used to comply with building regulations governing the size of openings between support members in many fences, depending on the relative sizes of the fence and the fan, it may be desirable to provide one or more spacers to further limit the size of openings between support members and the fan. Where the fan guard of the fan has a relatively large perimeter, as does the square fan guard 156 in the embodiment illustrated in FIG. 9, spacers may not be provided. Referring again to FIGS. 1A-B, however, four such spacers 110 may be disposed around fan 12. Here, spacers 110 are provided in the corners around fan 12 defined by the connections between top and bottom rails 20, 22 and struts 24.

Figure 5:
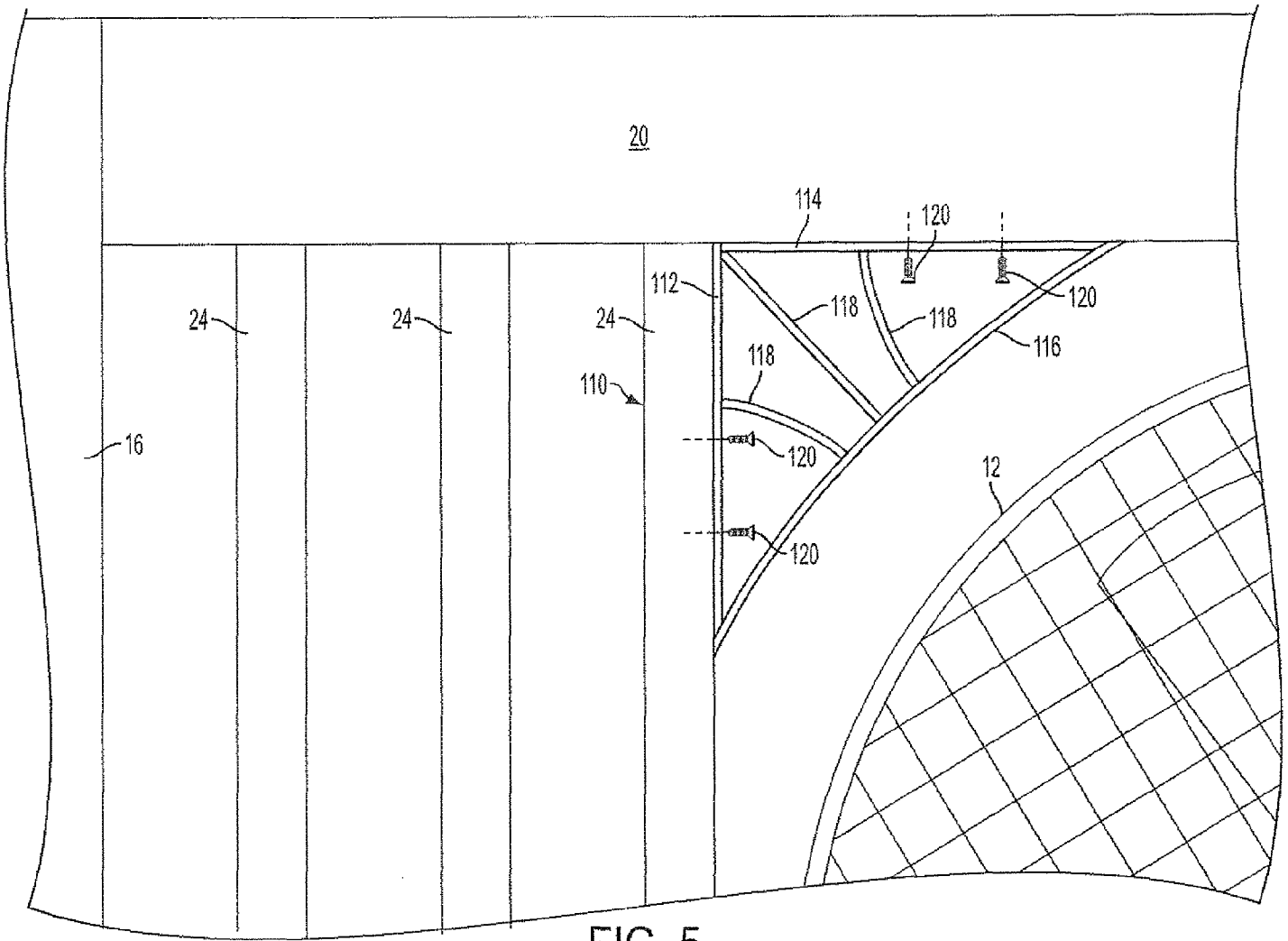
FIG. 5 is a front detail view of the cooling system of FIGS. 1A-B.

More particularly, FIG. 5 illustrates a spacer 110 in further detail. In this embodiment, spacers 110 may comprise first and second slats 112, 114 connected at a right angle. A slat 116 may be connected between distal ends of first and second slats 112, 114 and may take the shape of an arc. However, it will be appreciated that many different shapes for spacer 110 are contemplated. For example, slat 116 may be straight, such that spacer 110 is triangular in shape, or curved in the opposite direction, such that spacer 110 forms a sector of a circle.

Although spacers 110 may be solid, a plurality of buttresses 118 may be provided to strengthen spacers 100 that are hollow. This arrangement may facilitate attachment of spacers 110 to the various support members of a fence. Here, for example, spacer 110 may be attached to top rail 10 and strut 24 via suitable fasteners 120.

Figure 6:
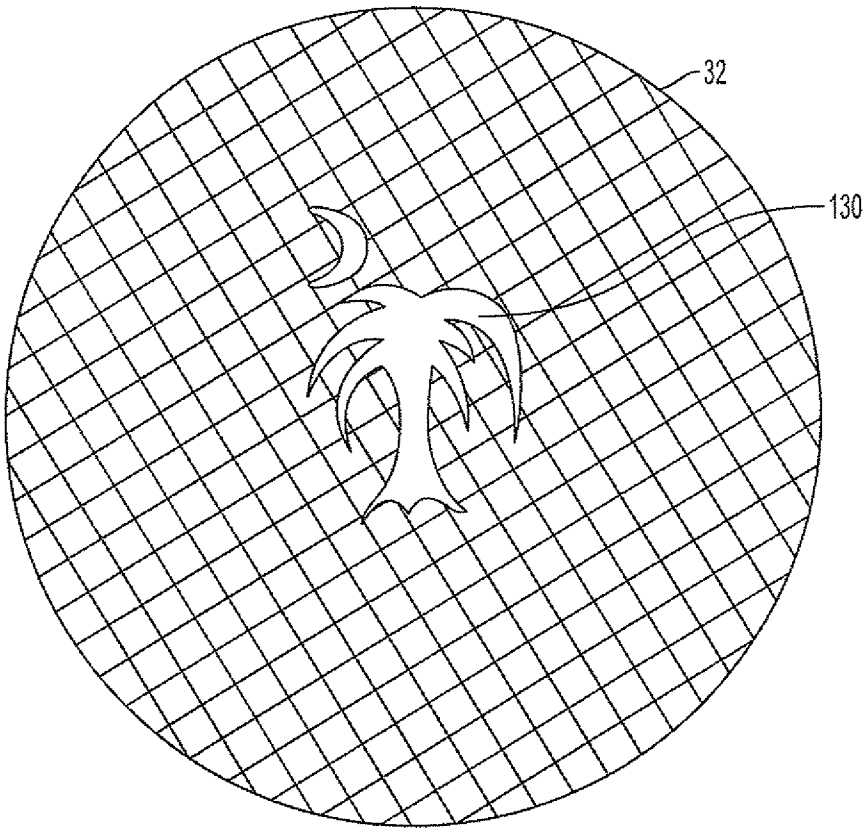
FIG. 6 is a front view of a fan guard grille comprising decorative indicia according to an embodiment of the present invention.

According to a further embodiment, the fan guard of the fan preferably comprises a coupling for decorative indicia. Preferably, the fan guard comprises a magnetic coupling so that various designs of decorative indicia may be interchangeably attached to the fan. In this regard, FIG. 6 is a front view of front fan guard grille 32, which comprises decorative indicia 130 according to an embodiment of the present invention. Although decorative indicia 130 is shown coupled to front grille 32, in a further embodiment, decorative indicia may additionally or alternatively be provided on rear grille 34. Decorative indicia 130 may preferably be a flat section of laser-cut metal or plastic. Here, for example, decorative indicia 130 is formed as a palmetto tree. However, decorative indicia may take any shape desired by a user, such as but not limited to school logos or mascots, animal shapes, or state symbols.

Figure 7:
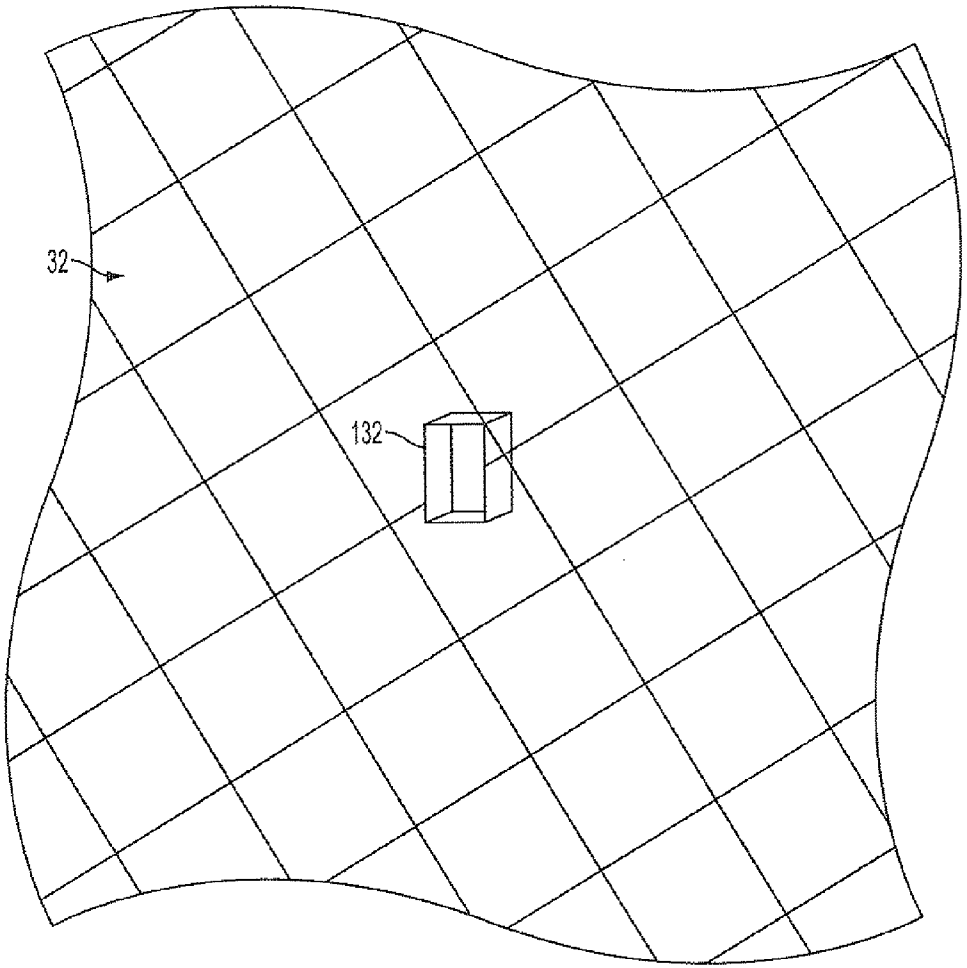
FIG. 7 is a detail view of the fan guard grille of FIG. 6 wherein the decorative indicia is removed according to an embodiment of the present invention.
Figure 8:
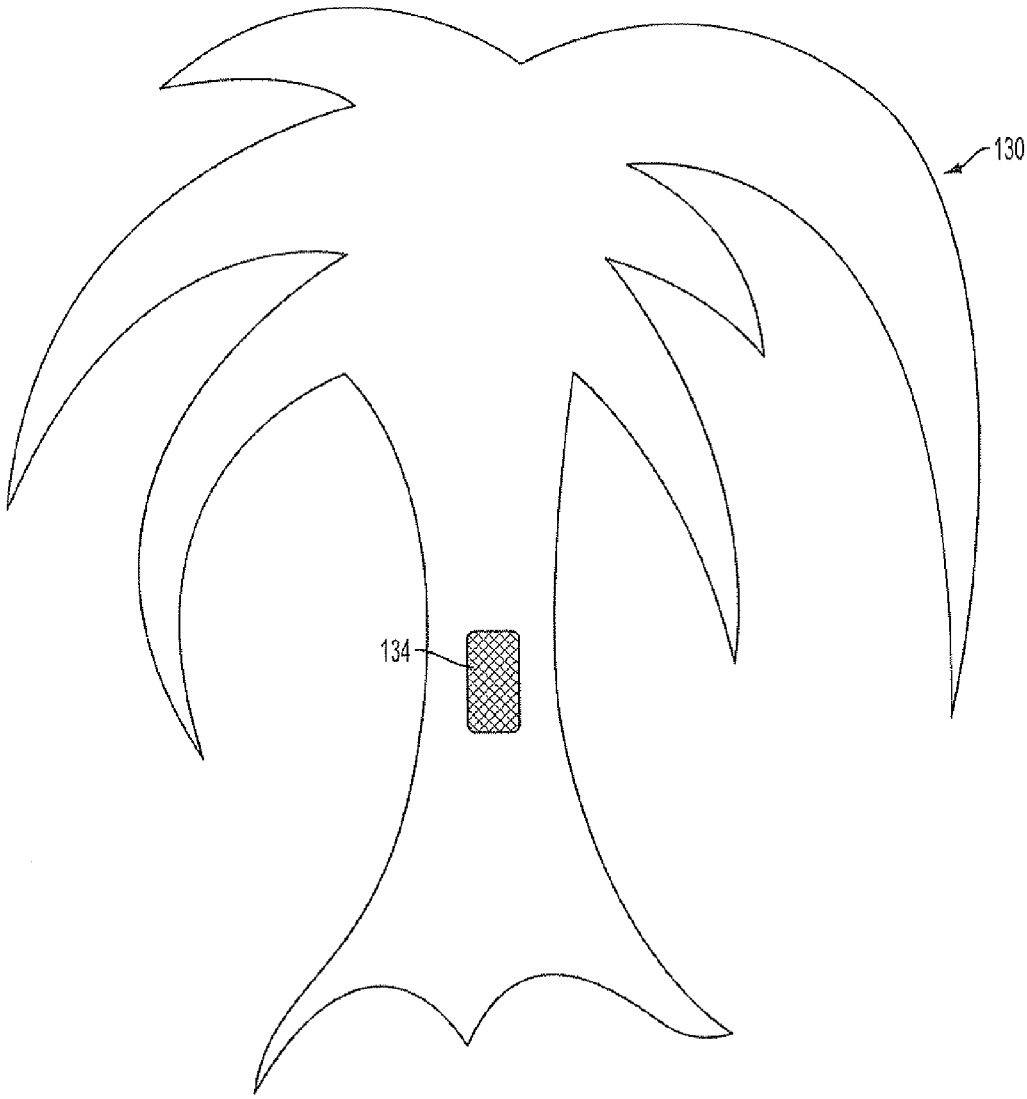
FIG. 8 is a rear view of the decorative indicia of FIG. 6.

An exemplary coupling for decorative indicia 130 is described below with reference to FIGS. 7 and 8. FIG. 7 is a detail view of font grille 32 wherein decorative indicia 130 is removed according to an embodiment of the present invention. FIG. 8 is a rear view of decorative indicia 130. In this embodiment, front grille 32 comprises a magnetic, box-shaped recess 132 configured to receive a magnet 134 affixed to the rear surface of decorative indicia 130. Magnet 134 may preferably be affixed to decorative indicia 130 by suitable adhesive, such as epoxy or the like. It will be appreciated that a magnetic coupling between recess 132 and magnet 134 may allow a user to easily interchange various decorative designs. However, other coupling arrangements for decorative indicia are contemplated, including clips, straps, adhesives, etc.

Figure 10:
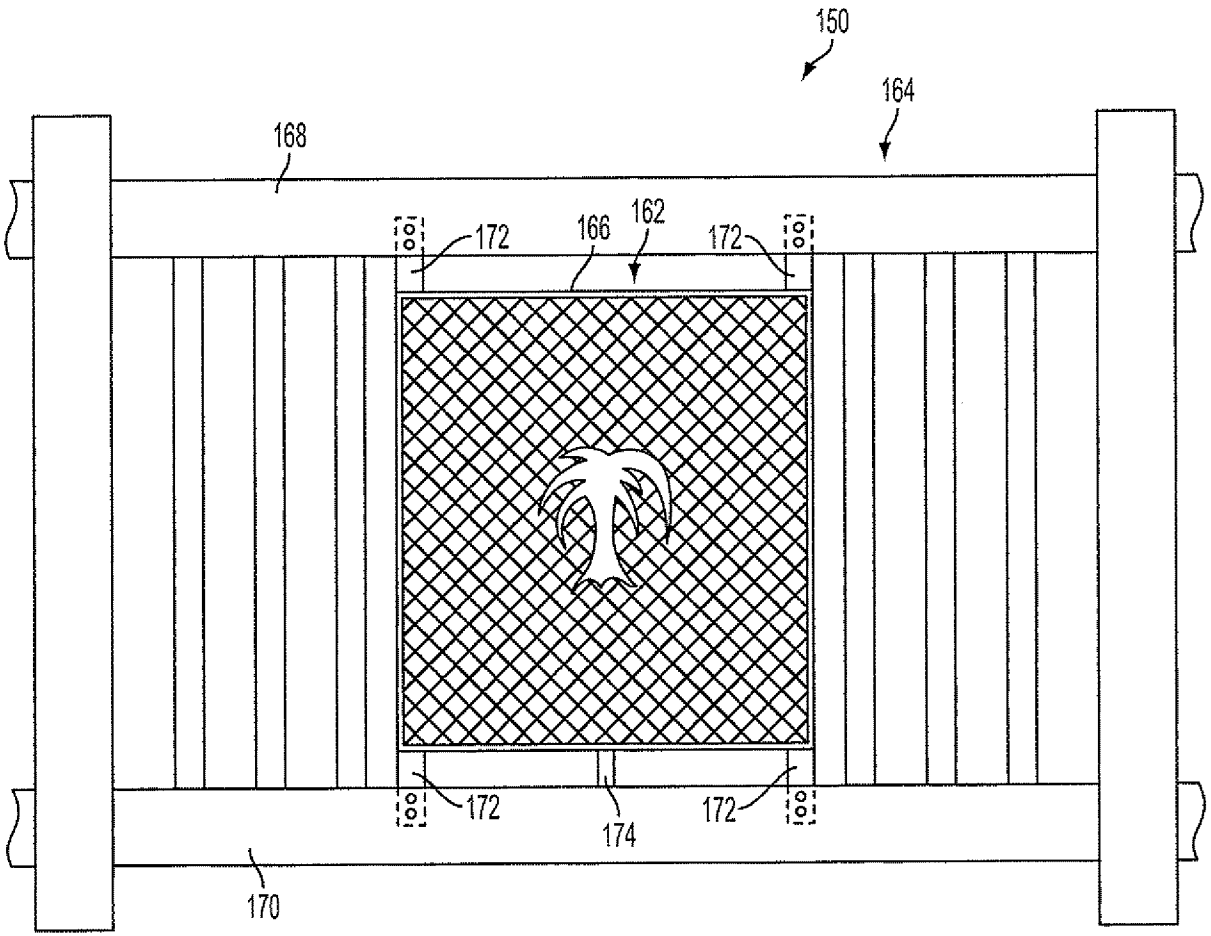
FIG. 10 is a front view of a cooling system according to a further embodiment of the present invention.

As noted above, according to a further embodiment, a cooling system may comprise a fan coupled with a fence such that fan is stationary with respect to the fence. In particular, FIG. 10 is a front view of a cooling system 160 comprising a fan 162 coupled with a fence 164. Similar to fan 152 illustrated in FIG. 9, fan 162 may have a square fan guard 166. In this embodiment, fan 162 may be coupled with top rail 168 and bottom rail 170 of fence 164 via mounting brackets 172. As shown, mounting brackets 172 may be elongate metal plates configured for connection to fan guard 166 and a surface of a respective one of top rail 168 and bottom rail 170. Mounting brackets 172 may be welded to fan guard 166 and coupled with rails 168, 170 via suitable fasteners or the like. Thereby, fan 162 may be stationary, i.e., fan 162 does not rotate relative to fence 164.

Wiring (not shown) extending from the motor of fan 162 may be in electrical communication with a power source via wiring extending through a conduit 174 depending from fan guard 166. Conduit 174 may also be coupled with bottom rail 170 so that the wiring may extend through or along a rear surface of bottom rail 174, as described above.

Figure 11:
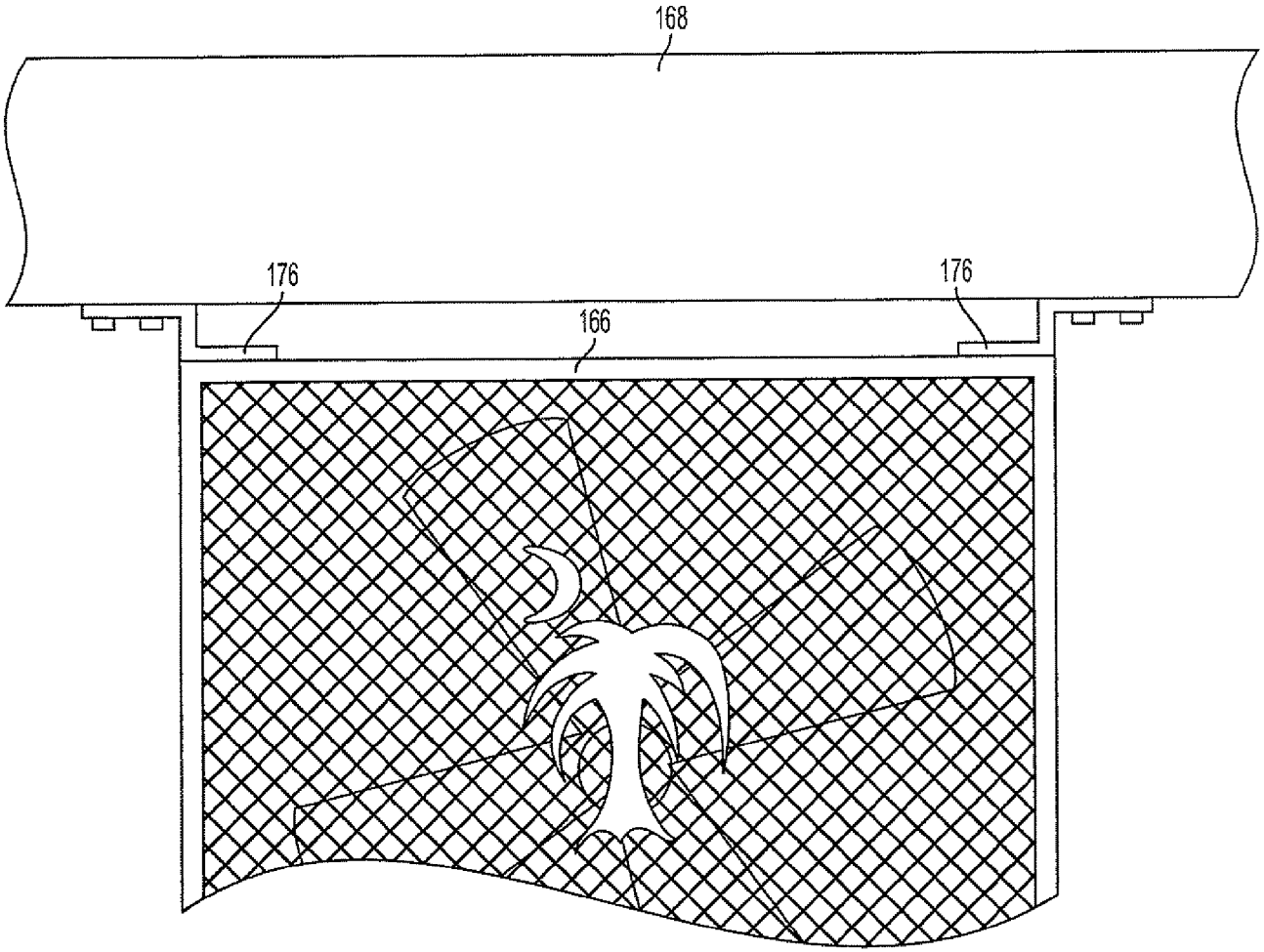
FIG. 11 is a partial front view of mounting brackets according to a further embodiment of the present invention coupled with the stationary cooling system shown in FIG. 10.

FIG. 11 is a partial front view of a further embodiment of a mounting bracket 176 coupled with the cooling system shown in FIG. 10. As shown, mounting bracket 76 is configured for connection between fan guard 166 and a respective one of top rail 168 and bottom rail 170. Here, as with mounting brackets 172 described above, mounting brackets 176 may be welded to fan guard 166 and coupled with top rail 168 via suitable fasteners. In this embodiment, mounting brackets 172 may be formed of "Z" shaped channel steel and may be coupled with a surface of rails 168, 170 that is parallel with the floor of a deck or the ground (i.e., a bottom or top surface, respectively, of top rail 168 or bottom rail 170). This may be useful where it is desired that a mounting bracket not be attached to (and thus visible on) a front or rear surface of fence 164. As with the other embodiments described above, fan 162 is positioned within fence 164 such that a gap formed between fan 162 and the struts does not exceed the maximum spacing between struts as established by building codes and regulations.

While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the scope and spirit thereof.

What is claimed is:

1. A fan configured for integration with a fence, wherein said fence has at least two support members, said fan comprising:
- a fan guard;
- a fan blade surrounded by said fan guard;
- first and second mounting brackets, wherein each of said first and second mounting brackets is configured for connection to a respective one of said support members;
- a first connector comprising a proximal end and a distal end, said proximal end of said first connector attached to said fan guard and said distal end of said first connector configured for connection to said first mounting bracket; and
- a second connector comprising a proximal end and a distal end, said proximal end of said second connector attached to said fan guard and said distal end of said second connector configured for connection to said second mounting bracket, wherein said second connector is disposed opposite said first connector on said fan guard;
- wherein said first and second connectors are adjustable with respect to said first and second mounting brackets;
- wherein said fan is configured to rotate between at least two struts of said fence; and
- wherein at least one of said first and second connectors cooperate with a respective one of said first and second mounting brackets to limit rotation of said fan between said at least two struts, wherein an opening defined by one of said struts and said fan guard does not exceed a predetermined size.

2. The fan of claim 1, wherein said fan guard comprises a shroud.

3. The fan of claim 2, wherein said fan guard comprises at least one grille.

4. The fan of claim 1, further comprising decorative indicia coupled to said fan guard.

5. The fan of claim 4, wherein said decorative indicia is magnetically coupled to said fan guard.

6. The fan of claim 1, wherein at least one of said first and second connectors comprises means for limiting rotation of said fan between said at least two struts.

7. The fan of claim 1, further comprising a variable-speed motor.

8. The fan of claim 7, wherein said motor is remotely-controllable.

9. The fan of claim 1, wherein said fan rotates about an axis defined between said first and second connectors when said first and second connectors are connected to said first and second mounting brackets, respectively.

10. The fan of claim 1, wherein said predetermined size does not exceed size requirements in building regulations of the jurisdiction in which said fence is located.

11. A cooling system for integration with a fence, wherein said fence comprises at least two support members, said cooling system comprising:
- a fan comprising:
  - a fan guard comprising a front grille and a rear grille, said fan guard defining an interior volume of said fan;
  - a motor coupled to said rear grille;
  - a fan blade coupled to said motor, wherein said fan guard surrounds said fan blade; and
  - first and second connectors attached to said fan guard;
- first and second mounting brackets slidably coupled to said first and second connectors, respectively, wherein said first and second mounting brackets are each configured for connection to a respective one of said at least two support members; and
- means for limiting rotation of said fan between said at least two struts of said fence; and
- a plurality of spacers configured for connection to said at least two struts, wherein said spacers reduce the size of openings between said at least two struts and said fan guard.

12. The cooling system of claim 11, further comprising a mister configured to be coupled to a liquid source.

13. The cooling system of claim 11, wherein said openings between said at least two support members and said fan guard does not exceed size requirements in building regulations of the jurisdiction in which said fence is located.

14. The cooling system of claim 11, further comprising decorative indicia coupled to said front grille.

15. An outdoor structure, comprising:
- a fence comprising a top rail, a bottom rail, and a pair of substantially parallel struts disposed between said top and bottom rails; and
- at least one fan coupled with said fence, said at least one fan comprising:
  - a fan guard comprising at least one grille;
  - a motor coupled to said at least one grille;
  - a fan blade coupled to said motor via a rotatable shaft, wherein said fan guard surrounds said fan blade;
  - first and second mounting brackets each mounted to a respective one of said top rail and said bottom rail;
  - a first connector comprising a proximal end and a distal end, said proximal end of said first connector attached to said fan guard and said distal end of said first connector configured for connection to said first mounting bracket; and
  - a second connector comprising a proximal end and a distal end, said proximal end of said second connector attached to said fan guard and said distal end of said second connector configured for connection to said second mounting bracket, wherein said second connector is disposed opposite said first connector on said fan guard;
- wherein said first and second connectors are adjustable with respect to said first and second mounting brackets; and wherein said at least one fan is rotatable about an axis defined by said first and second connectors.

16. The outdoor structure of claim 15, wherein rotation of said at least one fan is limited by interference between at least one first projection coupled to said distal end of at least one of said first and second connectors and at least one second projection coupled to a respective one of said first and second mounting brackets.

17. The outdoor structure of claim 16, further comprising at least one spacer configured for connection to one of said struts such that said spacer reduces the size of said opening between said strut and said grille.

18. The outdoor structure of claim 16, wherein an opening between one of said struts and said fan guard does not exceed size requirements in building regulations of the jurisdiction in which said fence is located.

19. The outdoor structure of claim 18, wherein said at least one fan comprises decorative indicia removably attached to said fan guard.

20. The outdoor structure of claim 15, wherein said at least one fan comprises a plurality of fans in electrical communication.

* * * * *